United States Patent [19]

Richardson

[11] Patent Number: 4,714,191

[45] Date of Patent: Dec. 22, 1987

[54] DISPENSING CARTON FOR PLASTIC BAGS

[75] Inventor: Paul D. Richardson, Cincinnati, Ohio

[73] Assignee: International Paper Company, Purchase, N.Y.

[21] Appl. No.: 24,428

[22] Filed: Mar. 11, 1987

[51] Int. Cl.[4] ..... B65D 85/67

[52] U.S. Cl. ..... 229/121; 229/122; 229/125; 229/167; 229/169; 229/182; 229/131; 206/390; 206/395; 206/408; 206/409; 206/631; 215/11.3; 225/10; 225/13; 225/48

[58] Field of Search ..... 229/121, 122, 125, 165, 229/167, 169, 172, 182; 206/390, 395, 408, 409; 215/11 E; 225/10, 13, 48, 49, 106

[56] References Cited

U.S. PATENT DOCUMENTS

| | | | |
|---|---|---|---|
| 2,115,867 | 5/1938 | McConnell | 206/408 X |
| 3,229,876 | 1/1966 | Osborn, Jr. | 225/49 |
| 3,281,036 | 10/1966 | Woodling | 225/49 |
| 4,016,975 | 4/1977 | Hammer | 206/390 |

*Primary Examiner*—William Price

*Attorney, Agent, or Firm*—Walt Thomas Zielinski

[57] ABSTRACT

A one piece paperboard carton blank is folded into a rectangular shape for packaging and dispensing from a roll of individual plastic bags, particularly disposable milk bottles for feeding babies. The carton has a double wall front part which includes an inner top rigidly supporting a tab protruding in a direction opposite to the direction of withdrawal of bags from the roll. When a first plastic bag is withdrawn it starts to pull out a succeeding bag to which it is removably attached along a line of perforations. When the center of the perforated edge of the succeeding bag is impaled on the tab, further withdrawal of the succeeding bag is restrained and the first bag is readily separated to facilitate its dispensing and to place the leading edge of the succeeding bag where it may be easily reached for withdrawal.

14 Claims, 6 Drawing Figures

FIG. 4
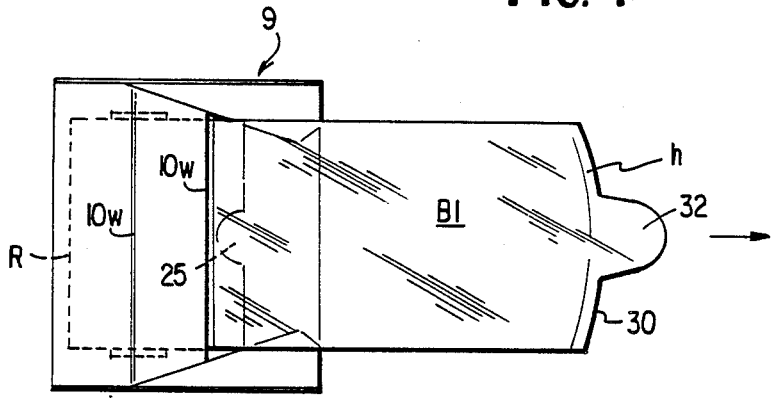
FIG. 5
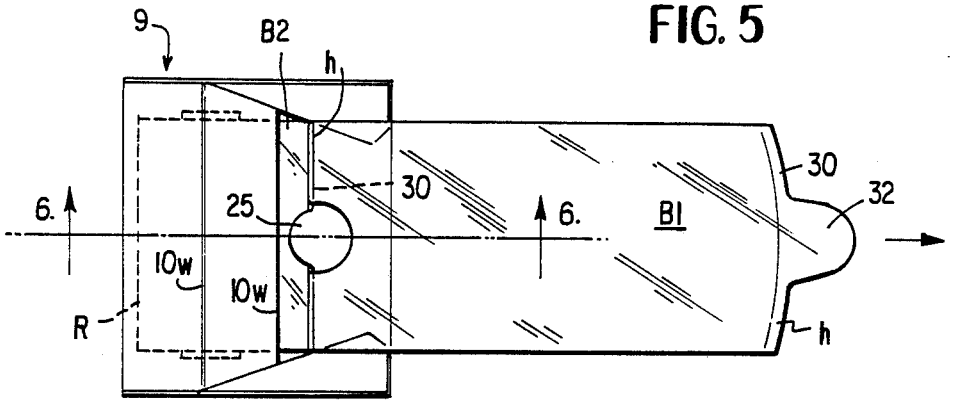
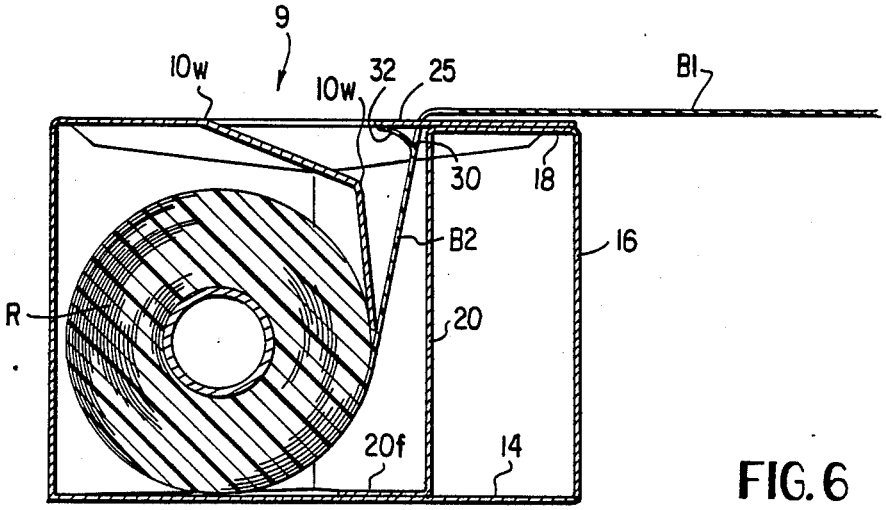
FIG. 6

DISPENSING CARTON FOR PLASTIC BAGS

BACKGROUND OF THE INVENTION

This invention relates to a paperboard carton blank and carton for packaging and dispensing plastic bags, more particularly disposable baby bottles, which are formed and packaged as a flat plastic tube in a continuous roll and separated for use by tearing them off along perforated lines in the tube which form the bags as separate units.

The well-known plastic bags called "Baggies" are formed and dispensed from the package in this manner. To form them, a continuous plastic tube of the desired size and strength is formed as by blow molding. The tube is heat-sealed to form seams at intervals which are the desired length of the bags and perforated at locations with respect to the heat seams such that a closed bag bottom is formed on one side of the perforations and an openable bag top on the other. Rolls of such bags are hung in supermarkets at the "produce" stands. If a customer buys tomatoes in bulk, he tears a plastic bag off the roll, inserts the tomatoes he wants and takes them to the checkout counter where they are weighed and paid for. Such bags are sold in packaged rolls.

The baby food industry has developed "disposable milk bottles". These are essentially small plastic bags which in use are fitted to a rigid plastic bottle holder from which baby drinks.

To facilitate dispensing, such a baby bottle may be formed with a tab or projection at the center of what becomes the bottom. The user pulls on this tab to withdraw a bottle and sever it along the perforation from the succeeding bottle to which it is attached.

The packaging industry has developed a carton part of the top of which, when severed along a perforation, has a central tab which, when pushed down into the carton interior, will tend to impale the leading edge of the succeeding bottle to help restrain it against the force required to separate the bottle being removed. But this tab protrudes in the direction of withdrawal of the bottles and has to be forced down against the bottles by the user's finger while the bottle being withdrawn is turned back against it.

As a part of the "floppy" top structure, this arrangement does not have much inherent strength. The user's finger would be just as effective without the tab.

It is accordingly the general object of this invention to provide an improved carton which has an operative tab structure of much greater rigidity and effective strength to resist the force required to remove and sever succeeding bags, particularly disposable baby bottles, and a blank for making it which can be formed into a tube and then shipped flat.

SUMMARY OF THE INVENTION

As will appear in the more detailed description and drawings, the carton is substantially rectangular in shape, is formed from a one piece blank of retail packaging type paperboard and has, from one end to the other of the blank top, back, bottom, front, inner top and inner front panels.

All but the inner top and inner front panels have pairs of flaps togetherforming the two sides of the carton. The inner top and inner front panels are folded back from the front panel so that the inner front panel lies parallel to and inside the front panel with its lower edge glued to the inside of the bottom. This forms a strong box at the front of the carton.

When the top panel is partly removed exposing the inner top panel, a tab on the latter projects rigidly inwardly against the direction of withdrawal of the bags or bottles to impale and restrain the leading edge of a succeeding plastic bag on a roll of such bags contained behind the inner front panel to thus facilitate severing the bag being withdrawn along the line of perforations beside the heat sealed bottom between the bags.

DESCRIPTION OF THE DRAWINGS

FIG. 4 is a top plan view of the opened carton with a first disposable bottle being initially withdrawn.

FIG. 5 is a top plan view similar to that in FIG. 4 with the first bag withdrawn far enough to impale the leading edge of a succeeding bag against the tab on the inner top panel of the carton.

FIG. 6 is a side elevation view of the carton in section with a roll of bags in it showing the leading edge of the succeeding bag being impaled and restrained against withdrawal while the first bag is severed from it and dispensed from the carton.

DETAILED DESCRIPTION

Figure 1:
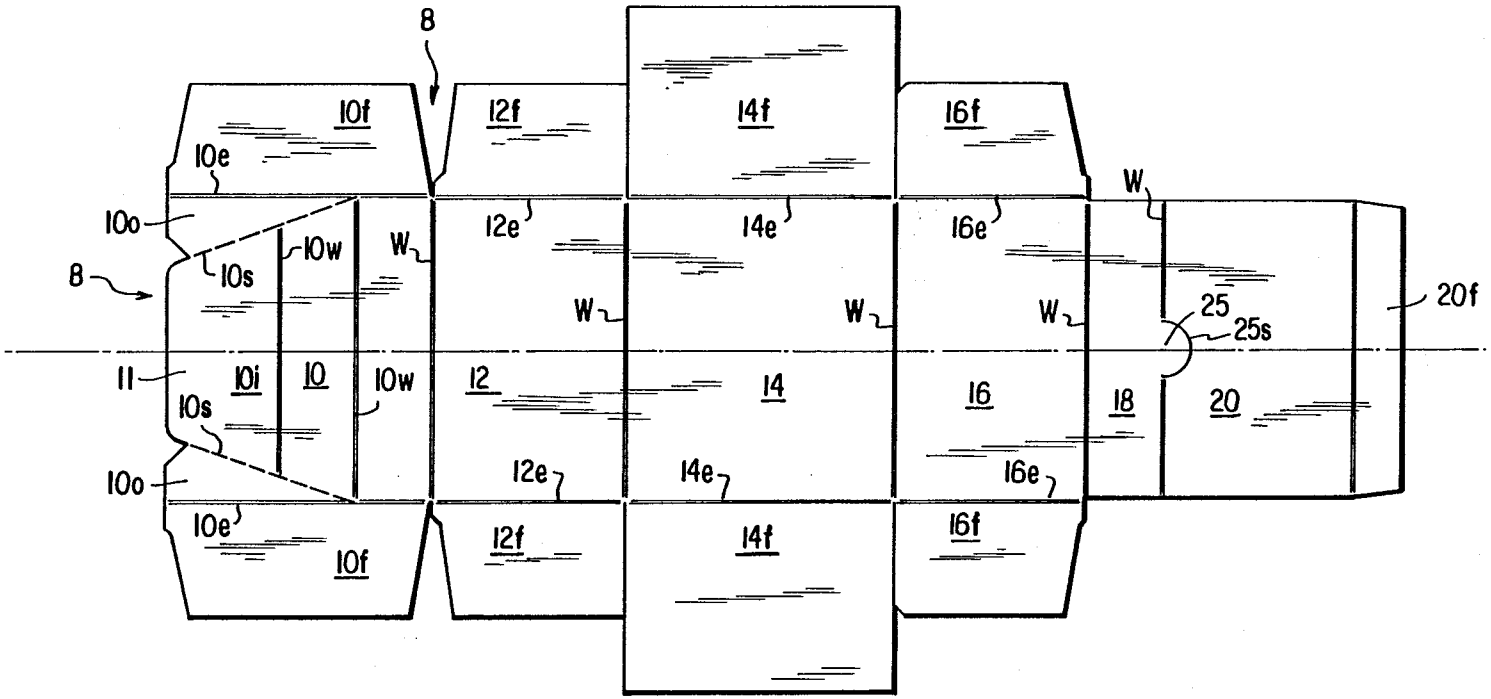
FIG. 1 is a view of the paperboard carton blank laid out flat.

A one piece paperboard carton blank is denoted by the numeral 8 in FIG. 1 for making a carton indicated by the numeral 9 in FIGS. 2–6 to contain plastic bags in a roll and from which to dispense such bags individually.

The carton is specifically developed and is particularly well adapted for packaging and dispensing bags which function as disposable baby bottles otherwise known as disposable milk bottles which are fitted to rigid plastic bottle holders from which the baby drinks milk with which the bags or bottles have been filled as is by now well-known in the art. A roll of such disposable milk bottles is designated by the letter "R" in FIGS. 2–6 and an individual bottle or bag being withdrawn from the roll R is designated as "B1" in FIGS. 4–6.

Referring particularly to FIG. 1, the blank 8 has a top panel 10, a back panel 12, a bottom panel 14, a front panel 16, an inner top panel 18, and an inner front panel 20 in the order named from one end of the blank to the other and foldable with respect to each other along lines of weakness W.

The top panel 10 has score lines **10*s*, i.e. perforated lines, in this case diagonally disposed, along which its inner part 10*i* may be severed from its outer parts 10*o* to open the carton for dispensing bags. Each of the top, back, bottom and front panels 10, 12, 14 and 16 has a pair of side flaps 10*f*, 12*f*, 14*f* and 16*f* foldably attached along its side edges 10*e*, 12*e*, 14*e* and 16*e*** and which are overlapped and secured to each other to form the sides of the erected carton.

The inner top panel 18 has a tab 25 defined by a slit **25*s* in the inner front panel, preferably semicircular in shape as shown. The tab 25 is arranged to be broken away from the inner front panel 20 and to be disposed generally in the plane of the surface of the inner top panel 18** in the erected carton.

To form the carton into an erected box-like condition, the blank manufacturer will normally fold the blank and secure it as by glueing into a tube with what is known in the trade as a manufacturer's joint, in this case a double tube with two manufacturer's joints.

Figure 2:
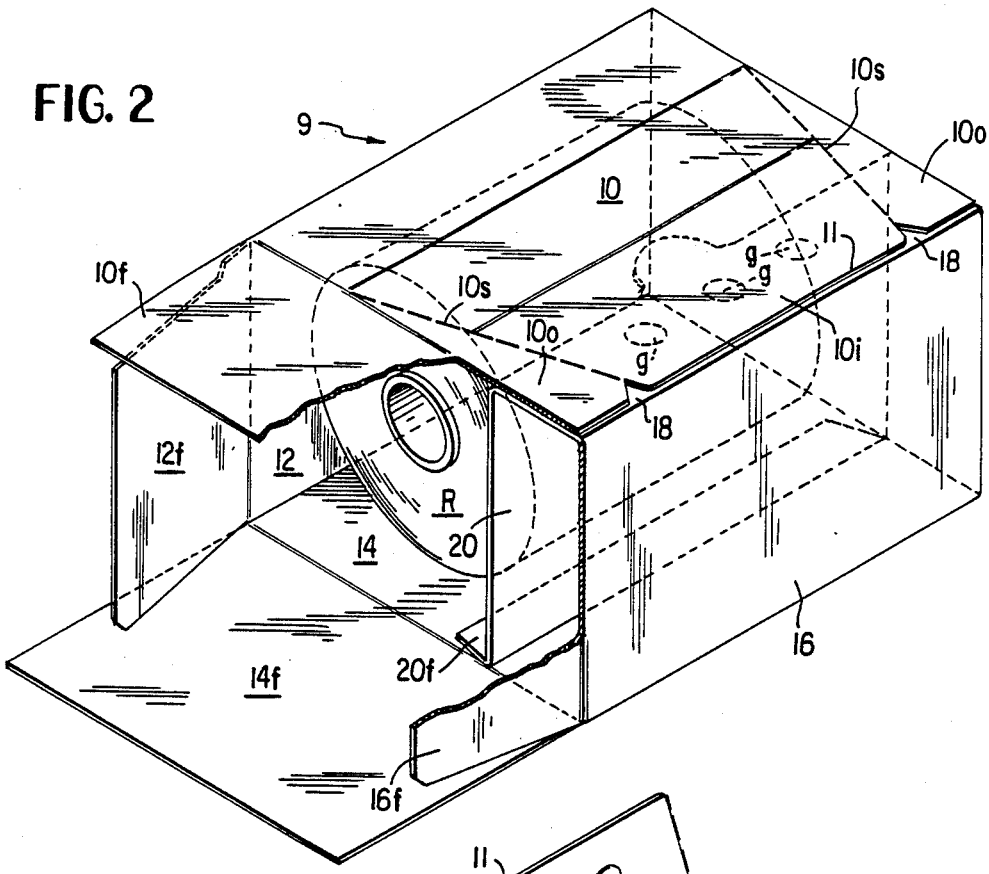
FIG. 2 is a perspective view partly broken away of a partially assembled carton containing a roll of plastic bags to be dispensed from the carton one by one.

As seen in FIGS. 1 and 2, to form one of these joints the end edge 11 of the top panel 10 is secured as by breakable glue spots g to the inner top panel 18. The other manufacturer's joint is formed by folding the inner front panel 20 so that it is parallel to the front panel 16 and securing it to the bottom 14 as by glueing its flap 20*f* to the bottom panel 14.

As seen in FIGS. 2 and 6, this arrangement forms a box-shaped beam in the erected carton to provide strength for the purpose to be described and at the same time allows the blank 8 in tube-like form to be folded flat as a parallelogram for shipment to the packager in compact stacked condition. The packager will erect the flattened blank into the condition shown in FIG. 2 with one side open and will insert the roll R of bags to be packaged and dispensed and will then fold the side flaps 10*f*, 12*f*, 14*f* and 16*f* into overlapped condition and glue them together to fill in the side designated by the flap 14*f* in FIG. 3.

Figure 3:
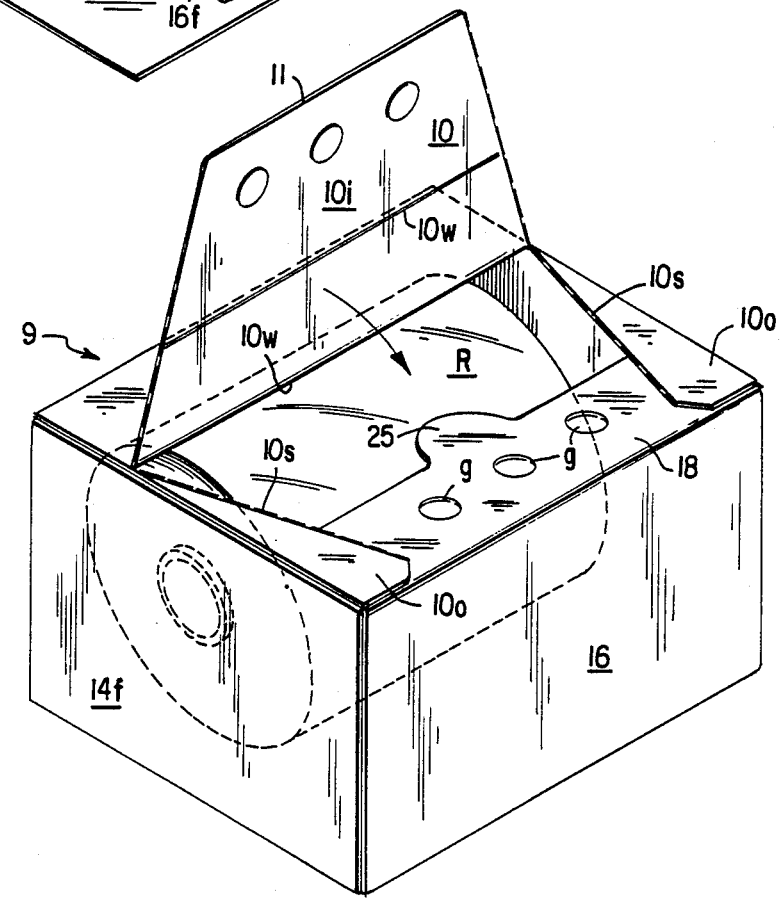
FIG. 3 is a perspective view of the carton with the inner part of the top panel broken away from its outer parts along scored lines and from its glued attachment to the inner top panel and partly showing and indicating the contained roll of plastic bags.

When the user wants to use a bag B1 from the packaged roll R, particularly a bag in the form of the disposable bottles in the roll R as described and illustrated herein, the user first opens the carton 9 by breaking away the inner part 10*i* of the top panel 10 along the scoes lines 10, thus severing it from its outer parts 10*o* and from the inner top 18 and the breakable glue spots g, thereby raising it to the position shown in FIG. 3.

As seen in FIGS. 4–6, the bags or bottles B1, B2, and so on, are formed as a continuous tube in the roll R and are separated from each other by a heat sealed seam h and an adjacent line of weakness in the form of perforations providing an end edge 30 in the shape shown in the embodiment illustrated, having a semi-circular center to form a tab 32 by which the bag or bottle can be conveniently withdrawn.

After raising the inner part 10*i* of the top 10 to open the carton, the customer now lowers it down into the carton and against the surface of one of the bottles B1 or B2 being withdrawn as seen in FIG. 6, this downward bending being conveniently accommodated along the lines of weakness 10*w*, first seen in FIG. 1. As the first bag B1 is being withdrawn, its surface drags against the tab 25 until the leading perforated edge 30 of the succeeding bag B2 reaches it as seen in FIG. 5 at which point it is impaled on the carton tab 25 as best seen in FIG. 6 restraining its further withdrawal.

In manufacturing the rolls of bags or disposable bottles of the shape shown and described herein for dispensing from the carton of this invention, the semicircular edge of the tab 32 of each bottle may be entirely separated as by a continuous slit from its adjacent edge on the next bottle for greater convenience in impaling the leading edge of a succeeding bottle on the carton tab 25 as the first bottle is being withdrawn as seen in FIG. 6, leaving connections between perforations on either side of the slitted bottle tab 32 to connect the successive bottles together until separated when dispensed. But this is not essential, since discontinuous separation may be sufficient.

While a carton structure which includes a tab for impaling a succeeding bag along the line of weakness is known in the art, the tab is on the center forward edge of an outside top part which is hinged on the opposite side and faces in the opposite direction from that of the tab on the carton of the present invention, and it faces in the direction of withdrawal of the bottles, and not opposite to that direction as in the present carton. The bottle being withdrawn has to be doubled back on itself to impale the succeeding bottle's edge. The tab is part of the closure and not under it, as in this invention. Since that tab is on the wavy end of a top part, it lacks adequate strength.

In the present invention the tab 25, which restrains withdrawal of the succeeding bag to allow separation of the bags, is an integral part of the box beam formed by the front 16, the inner top 18, the inner front 20 and the bottom of the carton as seen in FIG. 6, and therefore is retained in a strong and steady position and is not free to move about.

What is claimed is:

1. A one piece paperboard blank for a carton to contain plastic bags in a roll and from which to dispense such bags individually, said blank comprising:

(a) top (10), back (12), bottom (14), front (16), inner top (18) and inner front (20) panels in the order named from one end of the blank to the other and foldable with respect to each other;

(b) said top panel having score lines (10*s*) along which its inner part (10*i*) may be severed from its outer parts (10*o*);

(c) at least one of said top, back, bottom, and front panels having a pair of side flaps (10*f*,12*f*, 14*f*, 16*f*) foldably attached along its side edges (10*e*, 12*e*, 14*e*, 16*e*); and (d) said inner top panel having a tab (25) defined by a slit (25*s*) in the inner front panel, said tab being arranged to be disposed generally in the plane of the surface of the inner top panel in the erected carton.

2. A paperboard carton blank as set forth in claim 1 in which each of the top, back, bottom and front panels has a pair of side flaps.

3. A paperboard carton blank as set forth in claim 1 in which the inner part of the top panel has at least one transverse line of weakness (10*w*) along which it can readily be folded downward after it has been severed along the score lines from its outer parts and a carton has been erected from the blank.

4. A paperboard carton blank as set forth in claim 1 in which said blank is foldably formed into a flat tube with the end edge of the top panel secured to the inner top panel.

5. A paperboard carton blank as set forth in claim 1 in which said blank is foldably formed into a flat tube with the inner front panel secured to the bottom panel.

6. A paperboard carton blank as set forth in claim 5 in which the end edge of the top panel is secured to the inner top panel.

7. A paperboard carton blank as set forth in claim 1 in which the inner front panel has a glue flap (20*f*) for securing it to the bottom panel.

8. A paperboard carton blank as set forth in claim 7 in which said blank may be foldably formed into a flat tube with the inner front panel secured to the bottom panel by glue between its said glue flap and said bottom panel.

9. A carton formed from the blank as set forth in claim 1.

10. A rectangular paperboard carton to contain plastic bags in a roll and from which to dispense such bags individually, said carton comprising:

(a) top, back, bottom, front, inner top, inner front and side panels formed from a one piece blank;

(b) the lower edge of the inner front panel being secured to the bottom panel;

(c) the inner top panel having a relatively rigid tab projecting horizontally into the carton for impaling the leading edge of a succeeding bag along a line of weakness to allow a first bag to be detached from it along said edge and thereby dispensed from a roll of said bags;

(d) the end edge of the top panel being secured to the inner top panel;

(e) said top panel having score lines along which its inner part may be severed from its outer parts and broken away from the inner top panel; and (f) said inner part of the top panel being insertable downwardly into the carton while a first bag is being withdrawn from a roll of said bags to cause said leading edge of said succeeding bag to be impaled on said tab.

11. A paperboard carton as set forth in claim 10 in which the said side panels are formed by at least one pair of flaps attached to at least one of the top, back, bottom and front panels.

12. A paperboard carton as set forth in claim 10 in which the said side panels are formed by a pair of flaps attached to the top panel and at least one other pair of flaps attached to one of said back, bottom and front panels.

13. A paperboard carton as set forth in claim 10 in which the inner front panel has a glue tab on its said lower edge by which it is attached to the bottom panel.

14. A paperboard carton as set forth in claim 10 in which the inner front of said top panel has at least one transverse line of weakness along which it can be readily folded downwardly into the carton after it has been severed along said score lines from its outer parts.

* * * * *